US008005393B2

(12) United States Patent
Satomi

(10) Patent No.: US 8,005,393 B2
(45) Date of Patent: Aug. 23, 2011

(54) IMAGE FORMING APPARATUS WITH COOLING AIR BLOWING PORTIONS

(75) Inventor: Yoshiyasu Satomi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 417 days.

(21) Appl. No.: 12/254,430

(22) Filed: Oct. 20, 2008

(65) Prior Publication Data

US 2009/0110454 A1 Apr. 30, 2009

(30) Foreign Application Priority Data

Oct. 26, 2007 (JP) ..... 2007-279451

(51) Int. Cl.
*G03G 21/00* (2006.01)
*G03G 21/20* (2006.01)

(52) U.S. Cl. ..... 399/92; 399/341; 399/401

(58) Field of Classification Search ..... 399/92, 399/94, 320, 341, 401, 405
See application file for complete search history.

(56) References Cited

U.S. PATENT DOCUMENTS

| | | | | |
|---|---|---|---|---|
| 7,315,721 | B2 * | 1/2008 | Kitayama | 399/320 |
| 7,415,219 | B2 * | 8/2008 | Kawamata | 399/92 |
| 7,433,623 | B2 * | 10/2008 | Nakamura et al. | 399/92 |
| 2004/0091281 | A1 * | 5/2004 | Kimizuka | 399/92 |
| 2006/0133865 | A1 | 6/2006 | Nakamura et al. | 399/320 |

FOREIGN PATENT DOCUMENTS

| | | |
|---|---|---|
| JP | 4-68629 | 3/1992 |
| JP | 2001-255807 | 9/2001 |
| JP | 2005-112568 | 4/2005 |

* cited by examiner

*Primary Examiner* — Sophia S Chen
(74) *Attorney, Agent, or Firm* — Fitzpatrick, Cella, Harper & Scinto

(57) ABSTRACT

A sheet conveying apparatus includes a pair of first guides formed with a first opening; a pair of second guides; and a pair of third guides, wherein an air which has passed through a first opening of the pair of first guides is deflected to one pair of guides of the pair of the second guides and the pair of the third guides by the other pair of guides.

6 Claims, 12 Drawing Sheets

IMAGE FORMING APPARATUS WITH COOLING AIR BLOWING PORTIONS

BACKGROUND OF THE INVENTION

1. Field of the Invention

The present invention relates to an image forming apparatus which forms an image on a sheet.

2. Description of the Related Art

In the related art, an image forming apparatus, such as a copying machine, a laser beam printer, and a facsimile, transfers a toner image formed on an image bearing member onto a sheet and then heats the sheet by a fixing device to fix the toner image.

In recent years, the image quality of the image forming apparatus including a sheet conveying apparatus which conveys a sheet has been enhanced. The image forming apparatus flexibly copes with a thick coat sheet having a large thermal capacity. When such thick coat sheet having a large thermal capacity is used, the sheet which becomes very hot by being heated by the fixing device before it is conveyed to a discharge portion.

When the sheet is conveyed while still hot, toner is softened and is not fixed onto the sheet. The sheet is brought into contact with a conveying roller or the rib of a conveying guide arranged in a conveying path while still hot. As a result, there can be a roller trace or a rib trace on the toner image to cause unevenness on the image. When the hot sheet is discharged and stacked onto a discharge tray, the soft toner acts as an adhesive and can adhere onto the sheet which has been already discharged onto the discharge tray.

To solve such problems, before the sheet is discharged onto the discharge tray, the sheet is cooled by blowing air thereonto to harden the sheet (Japanese Patent Application Laid-Open No. 2001-255807).

Japanese Patent Application Laid-Open No. 2005-112568 and Japanese Patent Application Publication No. 4-68629 disclose an apparatus having an opening which passes air sent from a fan therethrough and is formed in a switching member which switches between two branched conveying paths to guide a sheet. In the configuration of Japanese Patent Application Laid-Open No. 2005-112568 and Japanese Patent Application Publication No. 4-68629, air flows into the branched conveying path branched from a conveying path through the opening of the switching member. The branched conveying path is a conveying path which guides the sheet to be switchback conveyed. The branched conveying path into which air flows is a conveying path which guides the sheet before being switchback conveyed and the sheet after being switchback conveyed. The branched conveying path is shared so as not to be branched into the conveying path which conveys the sheet before being switchback conveyed and the conveying path which guides the sheet after being switchback conveyed. The conveying interval between the previous sheet and the following sheet need to be long. The productivity of sheet conveying is limited.

As illustrated in FIG. 12, a fan F4 is provided in a forward conveying path R1 which conveys the sheet with a toner image fixed onto one side thereof by a fixing portion 200 to a discharge roller 201. In addition, a fan F5 which blows outside air onto the sheet with the toner image fixed onto one side thereof by the fixing portion 200 is provided in a reverse conveying path R2 which reverses the sheet and then conveys it to the discharge roller 201.

When the fans F4 and F5 are provided in the forward conveying path R1 and the reverse conveying path R2, respectively, the cost and the size of the apparatus can be increased.

Exhaust can be delayed due to the influence of the outside air blown from the fans F4 and F5 in two directions to increase the temperature in the apparatus body.

In No. 2006/0133865 (U.S. Patent Publication), to cool the sheets in different conveying paths by one fan, there is provided an airflow changing member which opens and closes a plurality of blowports provided corresponding to the conveying paths, respectively, to switch between the blowports which blow out air. There is provided the dedicated airflow changing member which switches between the conveying paths to be cooled. The size of the apparatus and the cost can be increased.

SUMMARY OF THE INVENTION

The present invention provides an image forming which can efficiently cool a sheet conveyed without increasing the cost and the size of the apparatus.

An image forming apparatus of the present invention includes apparatus includes a first conveying path which guides a sheet onto which an image is fixed; a second conveying path which is branched from the first conveying path in a branching portion; a third conveying path which joins the first conveying path on the downstream of the branching portion; an air blowout portion which is arranged so as to blow out air toward the image surface of the sheet guided in the first conveying path; a pair of first guides which forms the first conveying path and is formed with a first opening so that the air blown out from the air blowout portion can pass through the first conveying path; a pair of second guides which forms the second conveying path and is formed with a second opening which can introduce the air into the second conveying path; and a pair of third guides which forms the third conveying path and is formed with a third opening which can introduce the air into the third conveying path, wherein the air which has passed through the first opening of the pair of first guides is deflected to one pair of guides of the pair of the second guides and the pair of the third guides by the other pair of guides.

According to the present invention, the sheet which passes through the first conveying path, the second conveying path, and the third conveying path can be cooled by the air blown out from one air blowout portion. The cost and the size of the apparatus is not increased.

Further features of the present invention will become apparent from the following description of exemplary embodiments with reference to the attached drawings.

DESCRIPTION OF THE EMBODIMENTS

An exemplary embodiment of the present invention will be described below in detail using the drawings.

Figure 1:
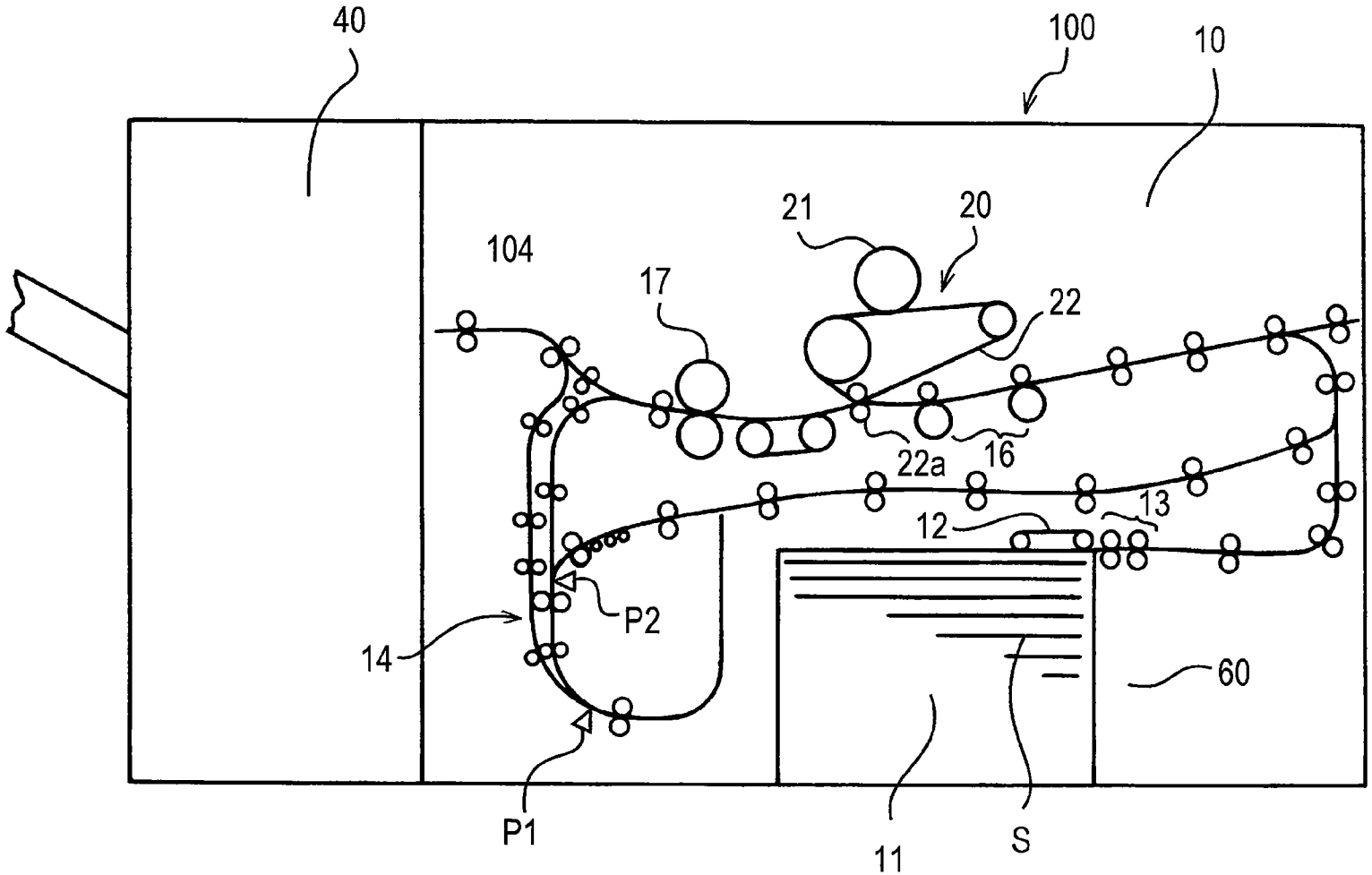
FIG. 1 is a diagram illustrating the schematic configuration of an image forming apparatus according to an embodiment of the present invention.

FIG. 1 is a diagram illustrating the schematic configuration of an image forming apparatus according to an embodiment of the present invention.

In FIG. 1, there are illustrated an image forming apparatus 100 and an image forming apparatus body (hereinafter, an apparatus body) 10.

The apparatus body 10 has an image forming portion 20 which forms an image on a sheet, and a sheet feeding portion 60 which feeds the sheet to the image forming portion 20. The apparatus body 10 has on one side a sheet processing apparatus 40 which subjects the image-formed sheet discharged from the apparatus body 10 to a binding process, a shift process, a folding process, and a punching process.

The image forming portion 20 has a photosensitive drum 21, a laser scanner unit which forms a latent image on the photosensitive drum 21, and a development device which stores toner and develops the latent image. The image forming portion 20 also has an intermediate transfer belt 22 onto which a toner image formed on the photosensitive drum 21 is transferred, and a transfer roller 22*a* which transfers the toner image of the intermediate transfer belt 22 onto the sheet.

The sheet feeding portion 60 has a sheet storing portion 11 which stores a sheet S, a feeding member 12 which feeds the sheet stored in the sheet storing portion 11, and a conveying roller 13 which conveys the sheet fed by the feeding member 12.

The operation of the thus-configured image forming apparatus 100 will be described. The photosensitive drum 21 is irradiated with a laser beam according to the image formed on the sheet from the laser scanner unit.

The previously charged photosensitive drum 21 is irradiated with the light to form an electrostatic latent image. The electrostatic latent image is developed by the development device to form the toner image on the photosensitive drum 21. The toner image formed on the photosensitive drum 21 is primarily transferred onto the intermediate transfer belt 22.

When a sheet feeding signal is outputted from a controller, not illustrated, to the sheet feeding portion 60, the sheet S is fed from the sheet storing portion 11. The fed sheet S is conveyed to the transfer portion having the intermediate transfer belt 22 and the transfer roller 22*a* with a predetermined timing by a conveying portion 16.

The toner image which has been primarily transferred onto the intermediate transfer belt 22 is transferred onto the sheet conveyed to the transfer portion. The image is transferred onto the upper side of the sheet conveyed in FIG. 1. The sheet is conveyed to a fixing portion 17 which is a fixing unit. The sheet S is heated and pressed by the fixing portion 17 to permanently fix the unfixed transfer image thereonto. The image-fixed sheet is discharged from the apparatus body 10 by a discharge roller 104 and is then conveyed to the sheet processing apparatus 40.

The image forming apparatus 100 according to this embodiment has a duplex image forming function and a reverse discharge function. In FIG. 1, a reverse conveying portion 14 reverses and discharges the sheet or conveys it to the image forming portion 20 again.

Figure 2:
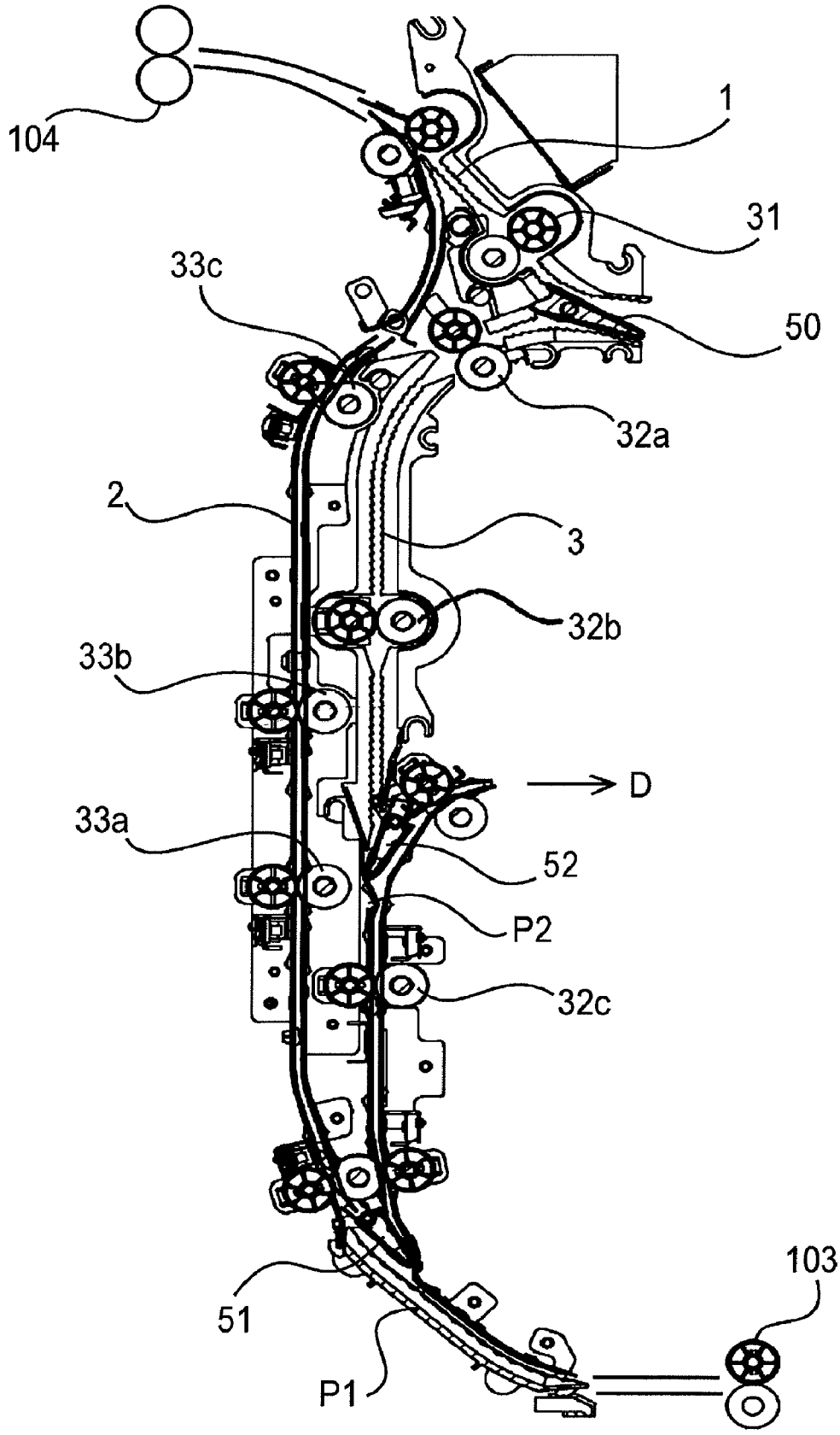
FIG. 2 is a diagram describing the configuration of a reverse conveying portion of the image forming apparatus.

FIG. 2 is a detailed diagram illustrating the periphery of the reverse conveying portion 14.

A straight conveying roller 31 is provided in a sheet discharge conveying path 1 which directly directs the image-formed sheet toward the discharge roller 104. As illustrated in FIG. 2, the reverse conveying portion 14 has a branched conveying path 3 which is branched from the sheet discharge conveying path 1 in a branching portion. Conveying rollers 32*a*, 32*b*, and 32*c* are provided in the branched conveying path 3. A reverse roller 103 which can be rotated forward and reversely is provided at the termination of the branched conveying path 3.

The reverse conveying portion 14 has a reverse discharge conveying path 2 which reverses and discharges the sheet onto which the toner image is fixed. Reverse discharge rollers 33*a*, 33*b*, and 33*c* are provided in the reverse discharge conveying path 2. The reverse discharge conveying path 2 joins the sheet discharge conveying path 1 on the downstream side.

When the sheet onto which the toner image is fixed is reversed and discharged, it is conveyed to the branched conveying path 3 and is then guided to the reverse discharge conveying path 2. In this embodiment, the reverse discharge conveying path 2 and the branched conveying path 3 configure a branched sheet forward conveying path which is branched from the sheet discharge conveying path 1.

In a straight discharge mode, the sheet which has passed through the fixing portion 17 passes through the sheet discharge conveying path 1 so as to be discharged from the apparatus body 10 by the discharge roller 104. The sheet is then conveyed to the sheet processing apparatus 40.

In a reverse discharge mode, the sheet which has passed through the fixing portion 17 is guided to the branched conveying path 3 by the switching of a first conveying path switching member 50. The sheet is then conveyed downward by the conveying rollers 32*a*, 32*b*, and 32*c* and the reverse roller 103. When the trailing end of the sheet reaches a reverse point P1, the reverse roller 103 provided in the branched conveying path 3 is reversely rotated to switch a second conveying path switching member 51. The sheet is thus conveyed to the reverse discharge conveying path 2. The sheet which has been conveyed to the reverse discharge conveying path 2 is conveyed upward by the reverse discharge rollers 33*a*, 33*b*, and 33*c*. The sheet which has been conveyed by the reverse discharge rollers 33*a*, 33*b*, and 33*c* is discharged from the apparatus body 10 by the discharge roller 104. The sheet is then conveyed to the sheet processing apparatus 40.

In a duplex mode which forms an image on both sides of the sheet, the sheet having a first side which has been subjected to the fixing process of the fixing portion 17 is guided to the branched conveying path 3 by the switching of the first conveying path switching member 50. The sheet which has been guided to the branched conveying path 3 is conveyed downward until the trailing end of the sheet reaches a reverse point P2 by the conveying rollers 32*a*, 32*b*, and 32*c* and the reverse roller 103. When the trailing end of the sheet reaches the reverse point P2, the sheet is conveyed in the direction of an arrow D by the reverse rotation of the conveying roller 32*c* and the reverse roller 103 and the switching of a third conveying path switching member 52. The sheet passes through a duplex conveying path 15 illustrated in FIG. 1 and is then conveyed to the image forming portion 12 again. An image is formed and fixed onto a second side of the sheet. The sheet is conveyed to the sheet discharge conveying path 1 and is then discharged from the apparatus body 10 by the discharge roller 104.

Figure 3:
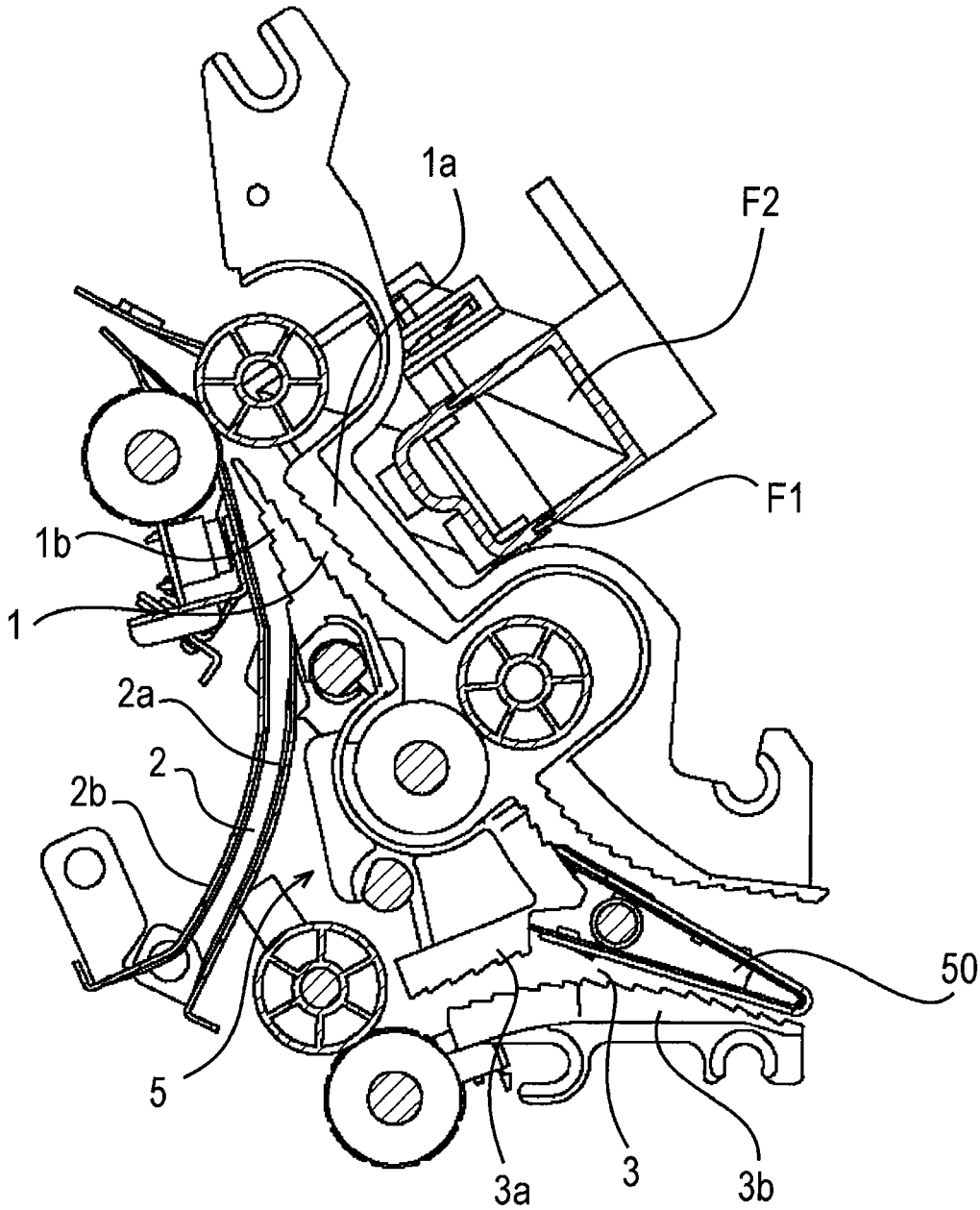
FIG. 3 is a diagram illustrating the configuration of a sheet discharge portion located in the upper portion of the reverse conveying portion.

FIG. 3 is a diagram illustrating the configuration of the sheet discharge portion located in the upper portion of the reverse conveying portion 14. As illustrated in FIG. 3, the sheet discharge conveying path 1 as a first conveying path has an upper conveying guide 1*a* and a lower conveying guide 1*b* which are a pair of first guides. The upper conveying guide 1*a* guides one of the sides of the sheet which passes through the sheet discharge conveying path 1. The lower conveying guide 1*b* guides the other side of the sheet which passes through the sheet discharge conveying path 1.

The discharge roller side end (or the upper end) of the reverse discharge conveying path 2 has a first conveying guide 2*a* and a second conveying guide 2*b*. The first conveying guide 2*a* guides one of the sides of the sheet which passes through the discharge roller side end (or the upper end) of the reverse discharge conveying path 2 (or the side of the sheet on the sheet discharge conveying path 1 side). The second conveying guide 2*b* guides the other side of the sheet which passes through the discharge roller side end (or the upper end) of the reverse discharge conveying path 2.

A first conveying path switching member side end (or the upper end) of the branched conveying path 3 as a second conveying path has an upper branch conveying guide 3*a* and a lower branch conveying guide 3*b* which are a pair of second guides. The upper branch conveying guide 3*a* guides one of the sides of the sheet which passes through the first conveying path switching member side end (or the upper end) of the branched conveying path 3 (or the side of the sheet on the sheet discharge conveying path 1 side). The lower conveying guide 3*b* guides the other side of the sheet which passes through the first conveying path switching member side end (or the upper end) of the branched conveying path 3.

In FIG. 3, F1 is a duct which configures an air blowout portion which blows out air toward the sheet discharge conveying path 1 and the reverse discharge conveying path 2 together with a fan F2. The air (or outside air) taken in by the fan is blown out from the duct F1 toward the upper conveying guide 1*a* in the sheet discharge conveying path 1.

Figure 4A:
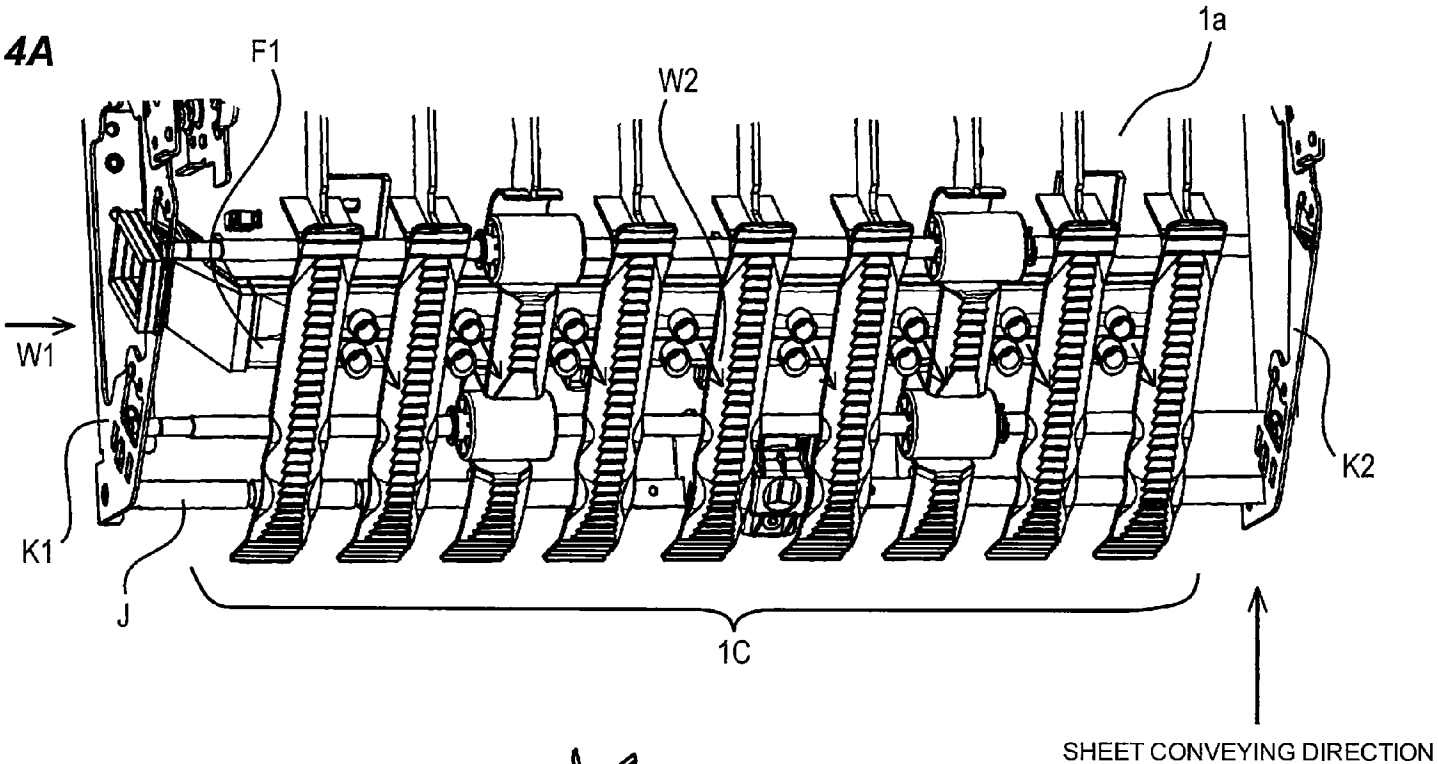
FIG. 4A is a diagram illustrating the configuration of an upper conveying guide in a sheet discharge conveying path provided in the sheet discharge portion.

As illustrated in FIG. 4A, the upper conveying guide 1*a* in the sheet discharge conveying path 1 has a plurality of conveying ribs 1*c* (or guide members) which are attached to a support shaft J with a pitch of about several tens of millimeters (e.g., 15 mm) and are extended along a sheet conveying direction. The top portions of the plurality of conveying ribs 1*c* are brought into contact with the sheet conveyed so as to guide it. The support shaft J is supported by side plates K1 and K2 provided on both sides in a direction crossing the conveying direction.

Figure 4B:
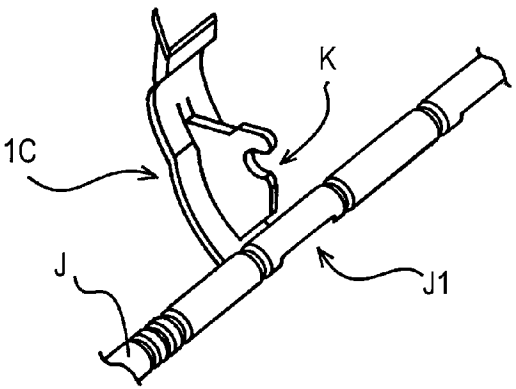
FIG. 4B is a diagram describing the attaching configuration of the upper conveying guide.

The plurality of conveying ribs 1*c* which are arranged side by side in a width direction crossing the conveying direction in the sheet discharge conveying path 1 are molded by a resin which has low conveying resistance and has abrasion resistance, e.g., a PC. As illustrated in FIG. 4B, the conveying rib 1*c* is fixed by lightly pressing a K portion into a groove J1 of the support shaft J and can be detached.

Cooling air is sent to the duct F1 by the fan, not illustrated, in the direction of an arrow W1, and is then blown out from the duct F1. The cooling air passes in the direction of an arrow W2 from the gap between the plurality of conveying ribs 1*c*. In this embodiment, when blown out from the duct F1, the air passes through a first air passing portion formed in the gap between the plurality of conveying ribs 1*c*.

Figure 5:
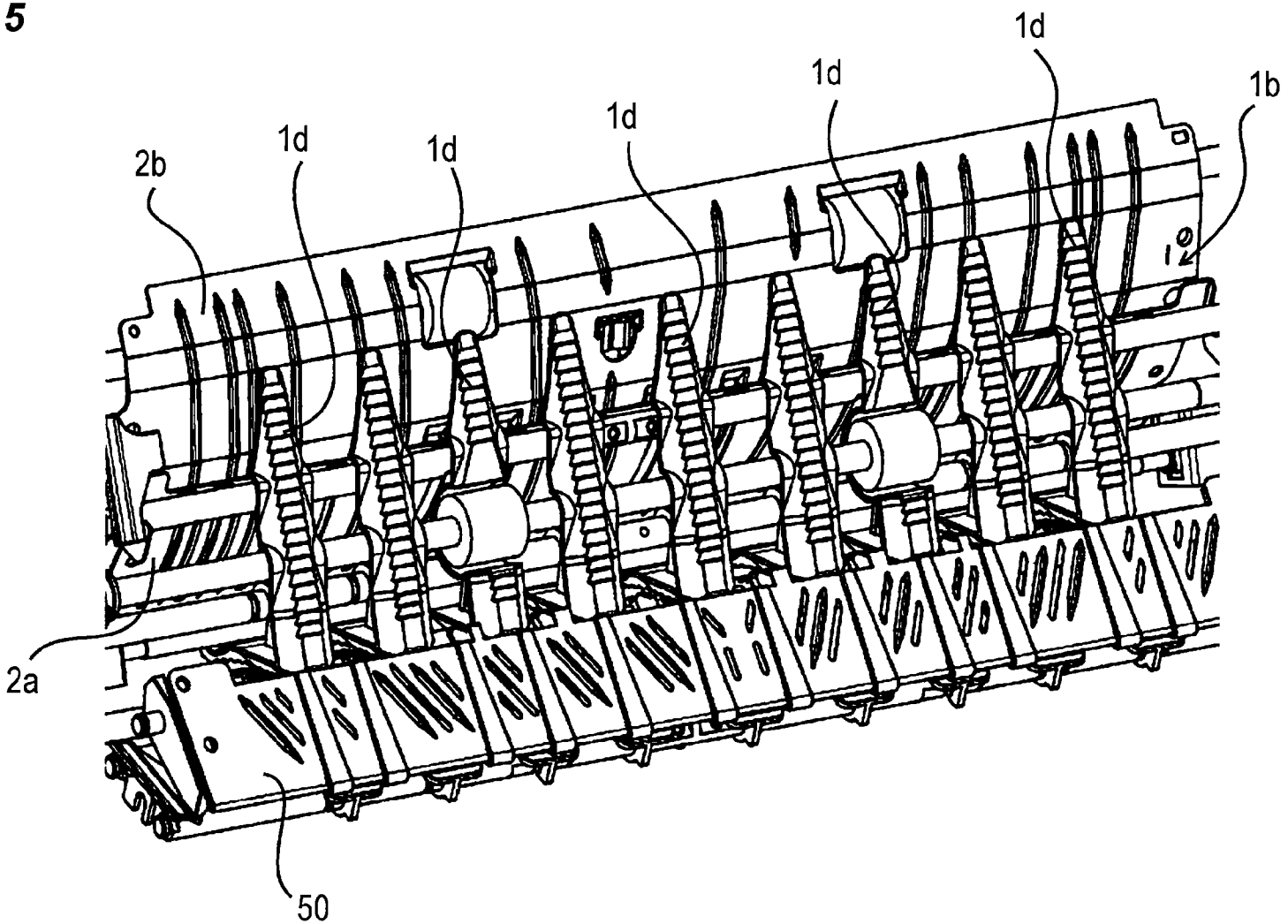
FIG. 5 is a perspective view illustrating the configuration of a lower conveying guide in the sheet discharge conveying path provided in the sheet discharge portion.

As illustrated in FIG. 5, the lower conveying guide 1*b* in the sheet discharge conveying path 1 has a plurality of conveying ribs 1*d* which are arranged side by side so as to be overlapped upward and downward with the same pitch as that of the conveying ribs 1*c* of the upper conveying guide 1*a*.

As illustrated in FIG. 4A, the cooling air which has been blown out from the duct F1 and has passed in the direction of the arrow W2 from the gap between the conveying ribs 1*c* passes through the gap between the plurality of conveying ribs 1*d*. In this embodiment, the air which has been blown out from the duct F1 and has passed through the upper conveying guide 1*a* passes through a second air passing portion formed in the gap between the plurality of conveying ribs 1*d*. The cooling air which has passed through the gap between the conveying ribs 1*d* of the lower conveying guide 1*b* is blown out toward the first conveying guide 2*a* of the reverse discharge conveying path 2.

The air which has been blown out from the duct F1 can pass through a first opening formed by the gap between the plurality of conveying ribs 1*c* which form the upper conveying guide 1*a* and the gap between the plurality of conveying ribs 1*d* which form the lower conveying guide 1*b*, and then pass through the sheet discharge conveying path 1.

Figure 6:
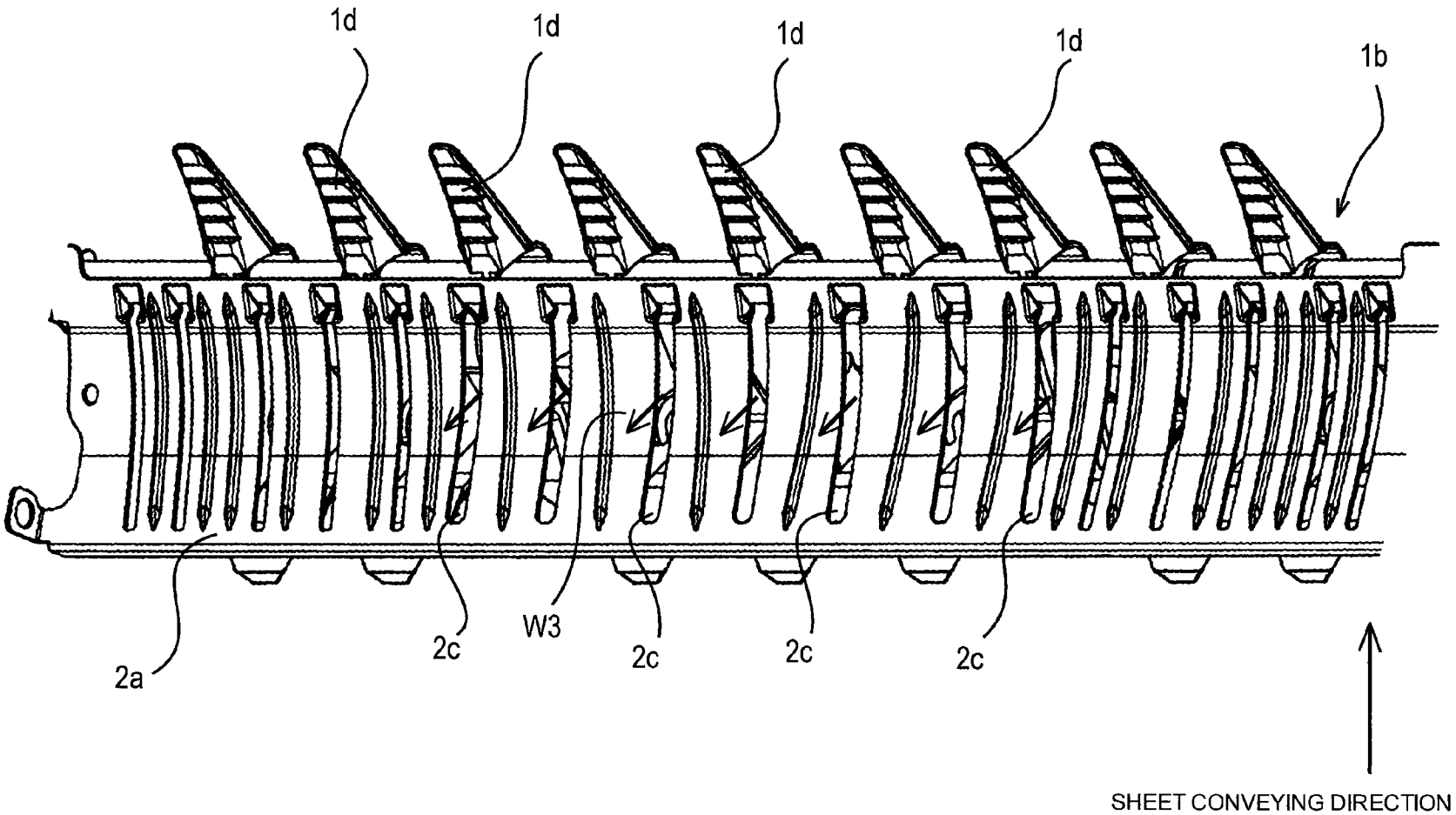
FIG. 6 is a perspective view illustrating the configuration of a first conveying guide in a reverse discharge conveying path provided in the reverse conveying portion.

The first conveying guide 2*a* in the reverse discharge conveying path 2 is formed of metal such as stainless steel and, as illustrated in FIG. 6, is formed with a vent hole 2*c* as a third opening which passes the cooling air so as to flow it into the reverse discharge conveying path 2 in the position opposite the pitch of the plurality of conveying ribs 1*d*.

The cooling air which has passed through the gap between the conveying ribs 1*d* of the lower conveying guide 1*b* and has been blown out toward the first conveying guide 2*a* in the reverse discharge conveying path 2 passes through the vent hole 2*c* in the direction of an arrow W3, and is then blown out toward the second conveying guide 2*b* of the reverse discharge conveying path 2. The air which has been blown out from the duct F1 (or the air blowout portion) which is arranged sidewise of the sheet discharge conveying path 1 on the opposite side of the reverse discharge conveying path 2 crosses the sheet discharge conveying path 1. The air is then blown into the reverse discharge conveying path 2 provided on the opposite side of the duct F1 in the sheet discharge conveying path 1.

Figure 7:
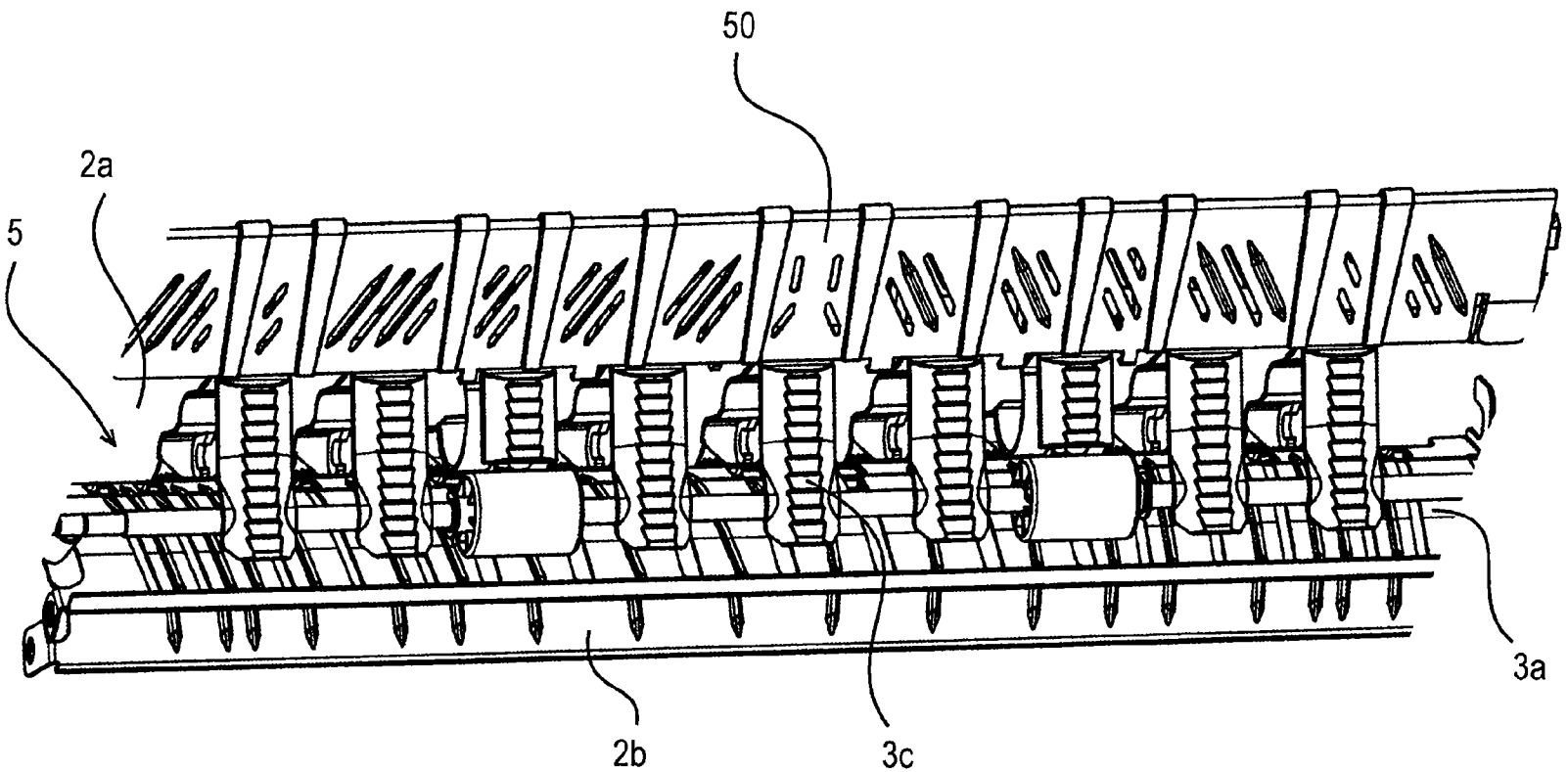
FIG. 7 is a perspective view illustrating the configuration of an upper conveying guide in a branched conveying path provided in the reverse conveying portion.

As illustrated in FIG. 7, the second conveying guide 2*b* in the reverse discharge conveying path 2 is not formed with the hole. The open-area rate of the first conveying guide 2*a* is higher than that of the second conveying guide 2*b*.

As illustrated in FIGS. 7 and 3, a communicating portion 5 which communicates with the reverse discharge conveying path 2 is provided near the branching point of the branched conveying path 3 from the sheet discharge conveying path 1.

As illustrated in FIG. 7, a plurality of conveying ribs 3*c* are arranged side by side along the sheet conveying direction in the same positions as those of the conveying ribs 1*d* of the lower conveying guide 1*b* on the communicating portion side of the upper branch conveying guide 3*a* in the branched conveying path 3. A second opening through which the air passes is formed in the gap between the plurality of ribs 3*c* which guide the sheet conveyed. The plurality of ribs 3*c* are molded by a resin which has low conveying resistance and has abrasion resistance, e.g., a PC.

The air which has been blown out to the reverse discharge conveying path 2 is deflected by the second conveying guide 2*b* in the reverse discharge conveying path 2 which is not formed with the vent hole. The air flows from the communicating portion 5 into the branched conveying path 3 through the gap between the conveying ribs 3*c* of the upper branch conveying guide 3*a* of the branched conveying path 3 (or through the second opening).

In this embodiment, the vent hole is not formed in the lower branch conveying guide 3*b* of the branched conveying path 3. The air which has been blown out to the branched conveying path 3 directly passes through the branched conveying path 3, and is then discharged to the outside of the apparatus body. The air which has been blown out from the duct F1 passes through the sheet discharge conveying path 1, the reverse discharge conveying path 2, and the branched conveying path 3 in that order, and is then discharged to the outside of the apparatus body. The delay of exhaust in the apparatus body can be prevented and as a result, the rising of the temperature in the apparatus body can be prevented. The sheet which passes through the sheet discharge conveying path 1, the reverse discharge conveying path 2, and the branched conveying path 3 can be cooled by one duct F1. This contributes to reduction of the size of the apparatus and the cost.

The operation of the thus-configured image forming apparatus 100 which cools the sheet onto which the toner image is fixed will be described.

Figure 8:
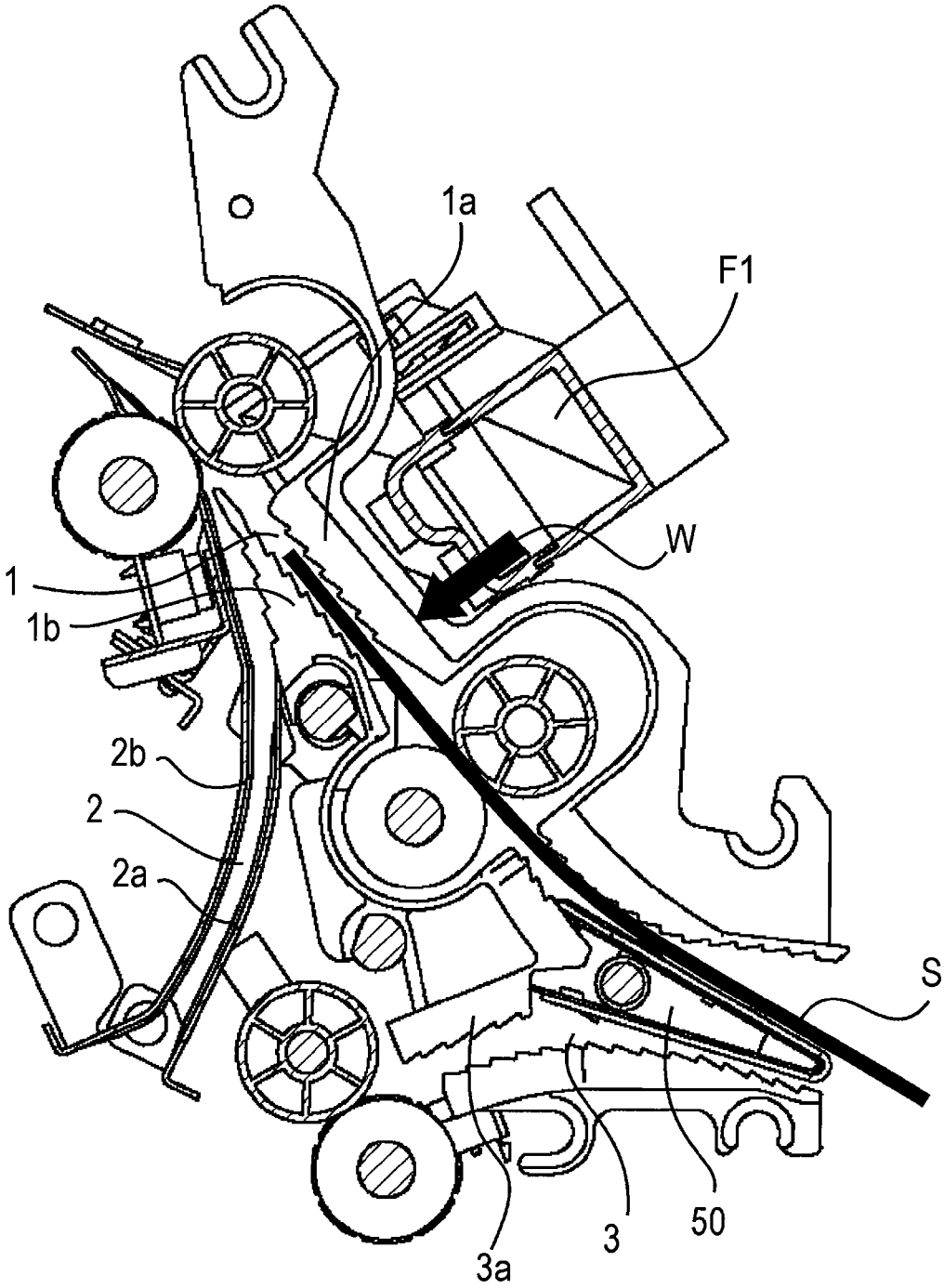
FIG. 8 is a diagram describing cooling of a sheet which passes through the sheet discharge conveying path.

FIG. 8 is a diagram describing cooling of the sheet in the sheet discharge conveying path 1 when it is straightly discharged. The sheet S which has been fixed by the fixing portion 17 is conveyed into the sheet discharge conveying path 1 by the first conveying path switching member 50. At this time, the sheet S which has just been subjected to the fixing process is hot. The sheet S1 which is passing through the sheet discharge conveying path 1 is sufficiently cooled by a cooling air W blown out by the duct F1 through the gap between the conveying ribs of the upper conveying guide 1*a* in the sheet discharge conveying path 1 (see FIG. 4). The sheet is then discharged from the apparatus body 10. The air which has been blown out from the duct F1 is blown out to the image surface of the sheet guided by the sheet discharge conveying path 1.

Figure 9:
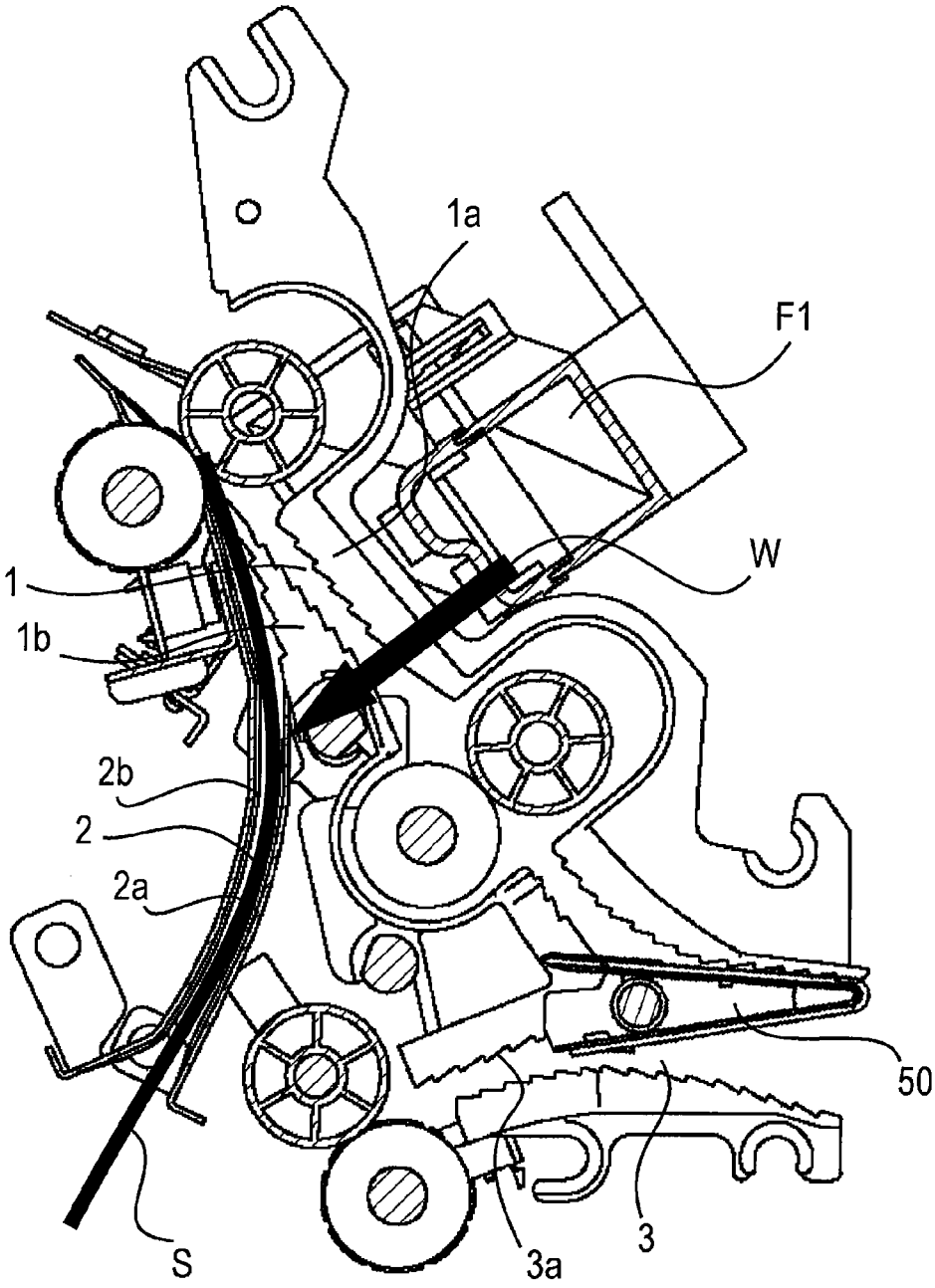
FIG. 9 is a diagram describing cooling of the sheet when the sheet in the reverse discharge conveying path is reversed and discharged.

FIG. 9 is a diagram describing cooling of the sheet in the reverse discharge conveying path 2 when it is reversed and discharged. The sheet S which has been subjected to the fixing process by the fixing portion 17 is conveyed into the branched conveying path 3 by the first conveying path switching member 50. The sheet S is conveyed to the reverse point P1 (see FIG. 2) and is then reversed so as to be conveyed to the reverse discharge conveying path 2.

The sheet S which has been conveyed to the reverse discharge conveying path 2 reaches the upstream side of the reverse discharge conveying path 2. The sheet S is then discharged from the apparatus body 10 by the discharge roller 104. When the sheet S is reversed and passes through the upstream side of the reverse discharge conveying path 2, the cooling air W is blown from the gap between the conveying ribs provided in the upper conveying guide 1*a* and the lower conveying guide 1*b* in the sheet discharge conveying path 1 and the vent hole 2*c* of the first conveying guide 2*a* in the reverse discharge conveying path 2 (see FIGS. 4 to 6).

The cooling air which has been blown out from the duct F1 crosses the sheet discharge conveying path 1 and is then blown into (or is blown out to) the reverse discharge conveying path 2. The sheet reversed and discharged which is passing through the sheet discharge conveying path 1 is sufficiently cooled by the cooling air W blown into the reverse discharge conveying path 2 by the duct F1, and is then discharged from the apparatus body 10.

Figure 10:
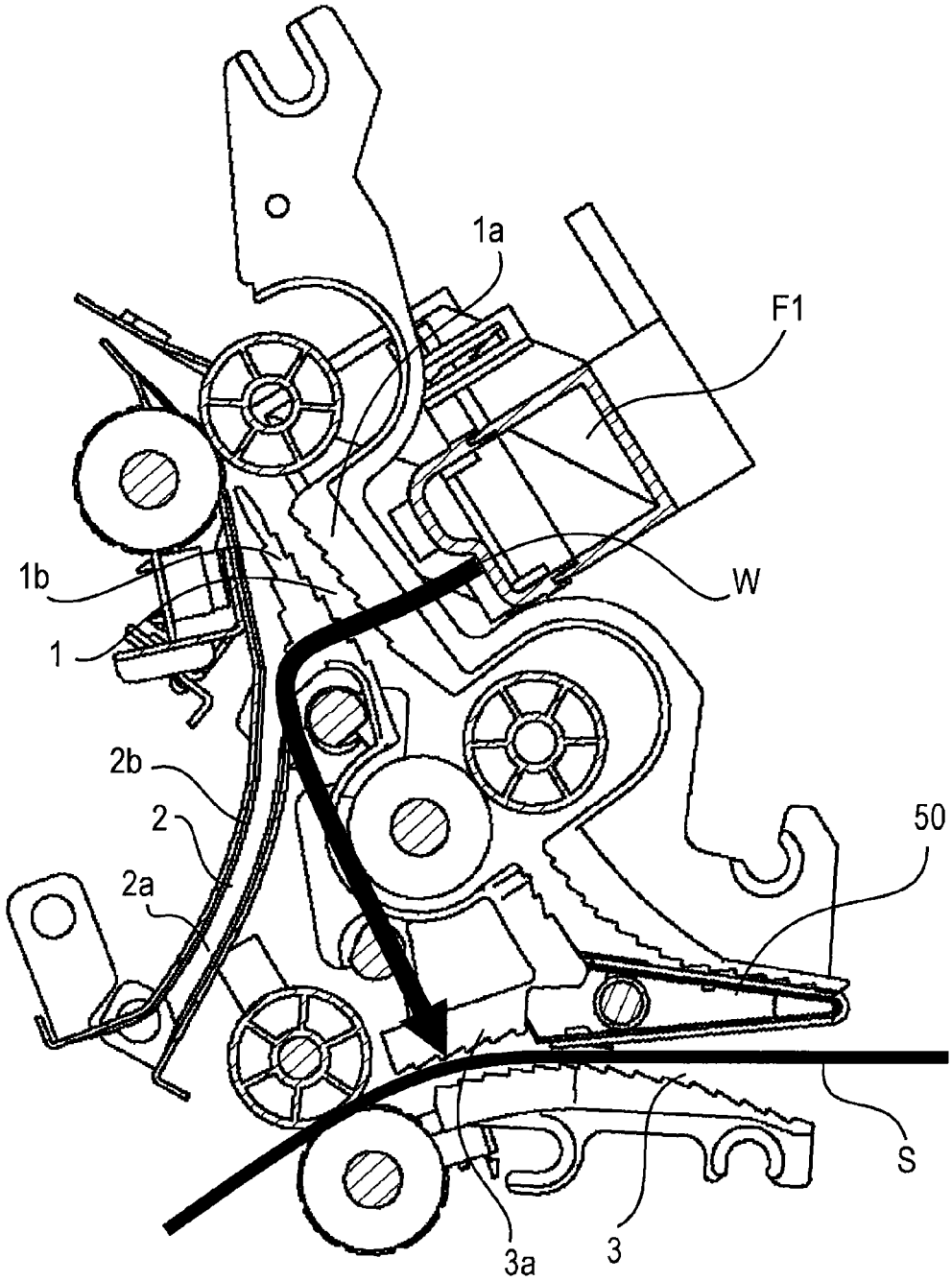
FIG. 10 is a diagram describing cooling of the sheet formed with an image on a first side thereof when the sheet in the branched conveying path is reversed and discharged or is formed with a duplex image.

FIG. 10 is a diagram describing cooling of the sheet formed with an image on a first side thereof in the branched conveying path 3 when it is reversed and discharged or a duplex image is formed. The sheet S which has been subjected to the fixing process by the fixing portion 17 is conveyed into the branched conveying path 3 by the first conveying path switching member 50. When the trailing end of the sheet reaches the reverse point P2 (see FIG. 2), the sheet S passes through the duplex conveying path 15 illustrated in FIG. 1 by the reverse rotation of the reverse roller 103 and the switching of the third conveying path switching member 52. The sheet S is then conveyed toward the image forming portion 12 again.

The cooling air which has been blown out by the duct F1 and has passed through the vent hole 2*c* of the first conveying guide 2*a* in the reverse discharge conveying path 2 so as to be deflected by the conveying guide 2*b* is blown out from the communicating portion 5 to the branched conveying path 3.

The sheet S which has been conveyed into the branched conveying path 3 and is passing through the branched conveying path 3 is sufficiently cooled by the air flown into the branched conveying path 3 through the communicating portion 5 and the gap between the plurality of conveying ribs 3*c* (or the second opening) configuring the upper branch conveying guide 3*a*. For duplex image formation, the sheet S can be sufficiently cooled and conveyed toward the image forming portion 12 again.

As described above, the cooling air which has passed through the vent hole 2*c* of the first conveying guide 2*a* of the reverse discharge conveying path 2 so as to be deflected by the conveying guide 2*b* passes through the communicating portion 5, and then flows into the branched conveying path 3.

When the sheet is present in the reverse discharge conveying path 2, the air which has passed through the vent hole 2*c* of the first conveying guide 2*a* in the sheet reverse discharge conveying path 2 is deflected by the sheet which is passing through the reverse discharge conveying path 2 so as to flow into the branched conveying path 3. The vent hole is provided in the conveying guide 2*b* in the reverse discharge conveying path 2 so as to exhaust the air to the outside of the apparatus when the sheet is not present in the reverse discharge conveying path 2. In this case, the air which has passed through the vent hole 2*c* is deflected by the sheet which is passing through the reverse discharge conveying path 2 so as to flow into the branched conveying path 3.

In the above embodiment, the vent hole is not formed in the second conveying guide 2*b* in the reverse discharge conveying path 2. Even if there is a small opening in the second conveying guide 2*b* in the reverse discharge conveying path 2, the open-area rate of the first conveying guide 2*a* may be higher than that of the second conveying guide 2*b* so as to deflect the air by the second conveying guide 2*b*. The small opening formed in the second conveying guide 2*b* in the reverse discharge conveying path 2 is formed to prevent dew condensation in the reverse discharge conveying path 2.

A Second Embodiment

In the above embodiment, the air which has been blown out from the duct F1 and has passed through the sheet discharge conveying path 1 is deflected by the reverse discharge conveying path 2 so as to be directed to the branched conveying path 3. In a second embodiment, the air which has been blown out from the duct F1 and has passed through the sheet discharge conveying path 1 is deflected by the branched conveying path 3 so as to be directed to the reverse discharge conveying path 2.

Figure 11:
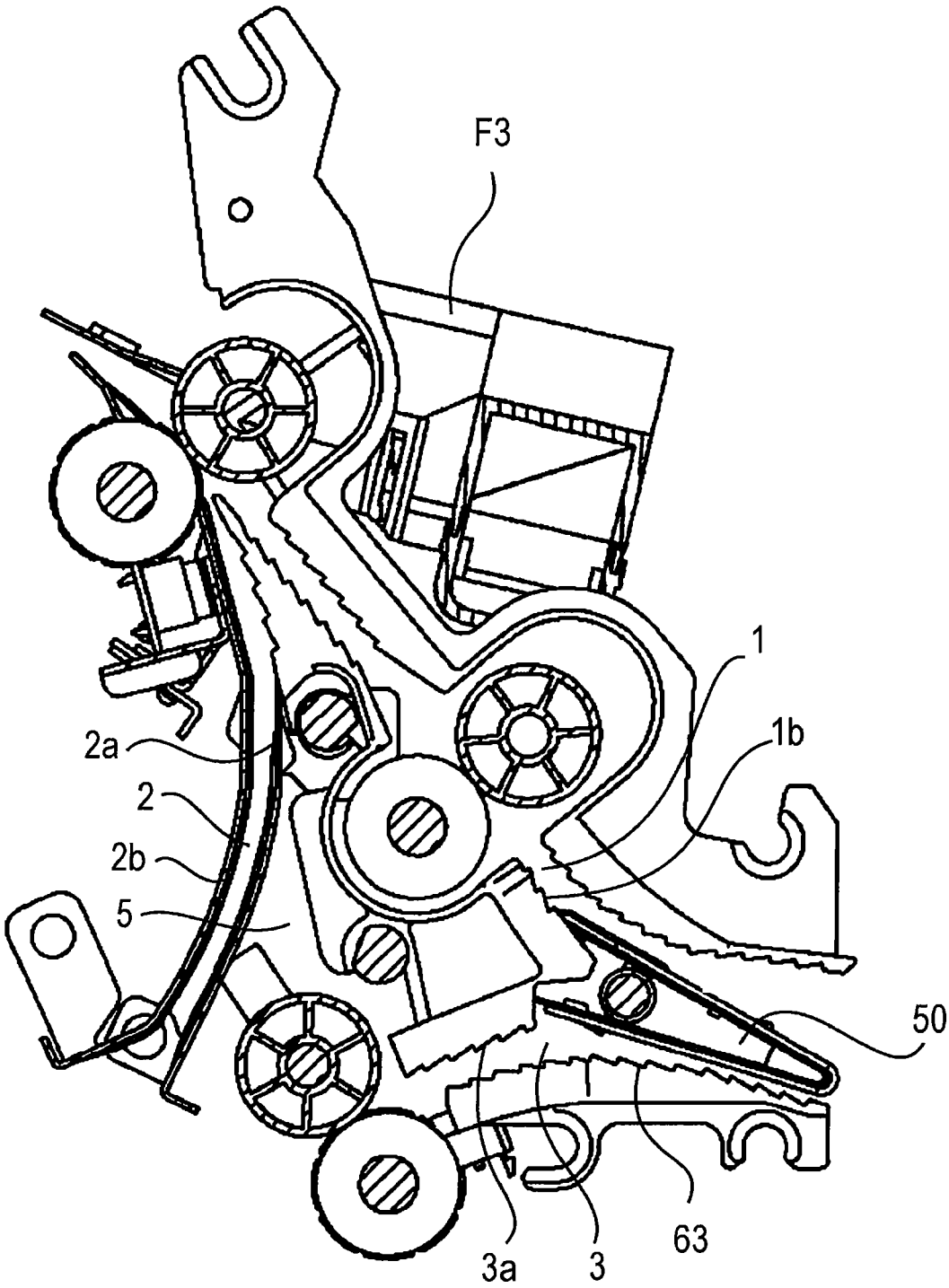
FIG. 11 is a diagram describing a second embodiment.
Figure 12:
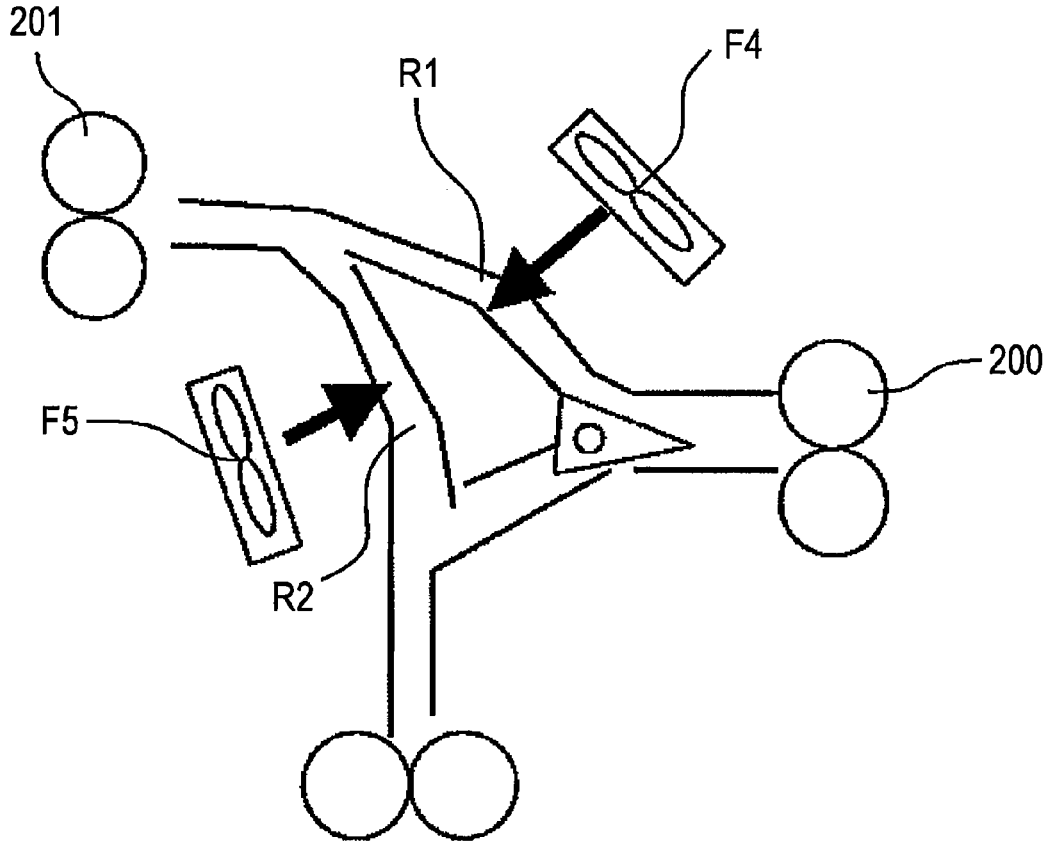
FIG. 12 PRIOR ART
FIG. 12 is a diagram describing the configuration of an image forming apparatus in the related art which cools the sheet.

FIG. 11 is a diagram describing the second embodiment. The direction of the air blown out from a duct F3 is different from that of the first embodiment. The air which has been blown from the duct F3 passes through the sheet discharge conveying path 1 and then flows into the branched conveying path 3. The configuration of the upper conveying guide 1*a* and the lower conveying guide 1*b* configuring the sheet discharge conveying path 1 is the same as that of the first embodiment.

The air which has flowed into the branched conveying path 3 is deflected by the lower branch conveying guide 63 downwardly of the upper branch conveying guide 3*a* and the lower branch conveying guide 63 configuring the branched conveying path 3. The upper branch conveying guide 3*a* has the same configuration as that of the first embodiment and is formed with an opening which flows the air into the branched conveying path 3.

The air which has been deflected by the lower branch conveying guide 63 is directed to the reverse discharge conveying path 2. The air which has been directed to the reverse discharge conveying path 2 flows into the reverse discharge conveying path 2 through the vent hole formed in the second conveying guide 2*a* which forms the reverse discharge conveying path 2. In the second embodiment, the open-area rate of the upper branch conveying guide 3*a* on the sheet discharge conveying path 1 side of the pair of conveying guides 3*a* and 63 which form the branched conveying path 3 is higher than that of the lower branch conveying guide 63 on the opposite side of the sheet discharge conveying path 1.

As discussed above, in both the first and second embodiments, the air which has been blown out from the duct (or the air blowout portion) crosses the sheet discharge conveying path 1, and is then blown out to the reverse discharge conveying path 2 and the branched conveying path 3. The sheet which passes through the sheet discharge conveying path 1, the reverse discharge conveying path 2, and the branched conveying path 3 can be cooled by one suction air blowout portion. The sticking of the discharged sheet can be prevented without increasing the cost and the size of the apparatus.

The sheet which has passed through the fixing portion once is conveyed to the image forming portion again to form an image on both sides of the sheet. The sheet which is being directed toward the image forming portion can be cooled. The rising of an atmosphere temperature near the image forming portion and the affection on the toner in the development device and the cleaner due to the heat of the sheet can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-279451, filed Oct. 26, 2007, which is hereby incorporated by reference herein in its entirety.

What is claimed is:

1. An image forming apparatus comprising:

a first conveying path which guides a sheet onto which an image is fixed;

a second conveying path which is branched from the first conveying path in a branching portion;

a third conveying path which joins the first conveying path on the downstream of the branching portion;

an air blowout portion which is arranged so as to blow out air toward the image surface of the sheet guided in the first conveying path;

a pair of first guides which forms the first conveying path and is formed with a first opening so that the air blown out from the air blowout portion can pass through the first conveying path;

a pair of second guides which forms the second conveying path and is formed with a second opening which can introduce the air into the second conveying path; and a pair of third guides which forms the third conveying path and is formed with a third opening which can introduce the air into the third conveying path, wherein the air which has passed through the first opening of the pair of first guides is deflected to one pair of guides of the pair of the second guides and the pair of the third guides by the other pair of guides.

2. An image forming apparatus according to claim 1, wherein the pair of third guides has a first guide portion on the first conveying path side which forms the third conveying path and a second guide portion on the opposite side of the first conveying path which forms the third conveying path together with the first guide portion, wherein an open-area rate of the first guide portion is higher than that of the second guide portion, wherein the air which has passed through the first opening of the pair of first guides passes through an opening of the first guide portion which forms the third conveying path so as to flow into the third conveying path, the air is deflected to the second conveying path by the second guide portion which forms the third conveying path, and the air which has been deflected by the second guide portion flows into the second conveying path through the second opening of the pair of second guides.

3. An image forming apparatus according to claim 2, wherein the guide of the pair of second guides on the third conveying path side is configured by a plurality of guide members which each have a top portion brought into contact with the sheet conveyed, are extended in a sheet conveying direction, and are arranged side by side in a width direction crossing the sheet conveying direction, wherein the second opening is formed by the gap between the plurality of guide members.

4. An image forming apparatus according to claim 1, wherein the pair of second guides has a first guide portion on the first conveying path side which forms the second conveying path and a second guide portion on the opposite side of the first conveying path which forms the second conveying path together with the first guide portion, wherein an open-area rate of the first guide portion is higher than that of the second guide portion, wherein the air which has passed through the first opening of the pair of first guides passes through an opening of the first guide portion so as to flow into the second conveying path, the air is deflected to the third conveying path by the second guide portion, and the air which has been deflected by the second guide portion flows into the third conveying path through a third opening of the pair of third guides.

5. An image forming apparatus according to claim 1, wherein the pair of first guides are configured by a plurality of guide members which each have a top portion brought into contact with the sheet conveyed, are extended in a sheet conveying direction, and are arranged side by side in a width direction crossing the sheet conveying direction, wherein the first opening is formed by the gap between the plurality of guide members.

6. An image forming apparatus according to claim 1, further comprising a reverse portion which reverses the sheet guided by the second conveying path, the sheet reversed by the reverse portion being guided by the third conveying path.

* * * * *